US005153113A

United States Patent [19]

Hirabayashi et al.

[11] Patent Number: 5,153,113

[45] Date of Patent: Oct. 6, 1992

[54] SILVER HALIDE PHOTOGRAPHIC LIGHT-SENSITIVE MATERIAL HAVING TWO BACKING LAYERS

[75] Inventors: Kazuhiko Hirabayashi; Kazuhiro Yoshida; Tomonobu Moriya, all of Hino, Japan

[73] Assignee: Konica Corporation, Tokyo, Japan

[21] Appl. No.: 714,495

[22] Filed: Jun. 13, 1991

[30] Foreign Application Priority Data

Jun. 18, 1990 [JP] Japan ..... 2-158929

[51] Int. Cl.[5] ..... G03C 1/06

[52] U.S. Cl. ..... 430/522; 430/523; 430/527; 430/529

[58] Field of Search ..... 430/522, 523, 527, 529

[56] References Cited

U.S. PATENT DOCUMENTS

| | | | |
|---|---|---|---|
| 4,130,430 | 12/1978 | Sugiyama et al. | 430/522 |
| 4,940,655 | 7/1990 | Gundlach | 430/527 |
| 5,035,986 | 7/1991 | Sakai et al. | 430/522 |
| 5,077,185 | 12/1991 | Cho et al. | 430/527 |
| 5,079,136 | 1/1992 | Tachibana et al. | 430/527 |

*Primary Examiner*—Jack P. Brammer

*Attorney, Agent, or Firm*—Frishauf, Holtz, Goodman & Woodward

[57] ABSTRACT

A silver halide photgraphic light-sensitive material is disclosed. The light-sensitive material is comprises a support, a silver halide emulsion layer provided on a surface of said support, an antistatic layer comprising a water-soluble conductive polymer, hydrophobic polymer particles and an epoxy curing agent, which is provided on the surface of said support opposite to the surface on which said emulsion layer is provided, and a hydrophilic colloid layer adjacently provided on said antistatic layer which contains a dye represented by the following Formula I:

(I)

wherein Qs are independently an aliphatic group or an aromatic group; R is a hydrogen atom, an aliphatic group or an aromatic group; Ms are independently a cation; L is a methine group; n is an integer of 0, 1 or 2; and p is an integer of 1 or 2. The photographic material is improved in antistatic property and inhibited in the color remaining after processing.

9 Claims, No Drawings

SILVER HALIDE PHOTOGRAPHIC LIGHT-SENSITIVE MATERIAL HAVING TWO BACKING LAYERS

FIELD OF THE INVENTION

The present invention relates to a silver halide photographic light-sensitive material, and more particularly to a silver halide photographic light-sensitive material which has an excellent antistatic characteristic and shows little residual color after its processing.

BACKGROUND OF THE INVENTION

Plastic films have conventionally been used as the support of light-sensitive materials. In general, the plastic film is so liable to be electrostatically charged as to bring about various problems in application; a plastic film such as polyethylene terephthalate film has the disadvantage that it is very liable to be electrostatically charged particularly when used under low-humidity conditions as in the winter season. It is especially important to take antistatic measures for the recently prevailing rapid coating of a high-sensitivity photographic emulsion or exposure of a high-sensitivity photographic material in an automatic printer.

Where a light-sensitive material is electrostatically charged, the static electricity attracts forein matter such as dust to generate pinholes or, when discharged, causes static marks to appear on the light-sensitive material to thereby degrade its photographic image quality and considerably lower its operation efficiency. For this reason, the light-sensitive material generally contains an antistatic agent or has an antistatic layer as described in French Patent No. 2,318,442, British Patent No. 998,642, and U.S. Pat. Nos. 4,078,935, 3,801,325, 4,701,403 and 4,585,730.

However, the light-sensitive material based on the above conventional techniques has the disadvantage that the antistatic characteristic thereof is liable to be deteriorated even after its processing. Where an antihalation dye-containing backing layer is provided adjacent to the antistatic layer, the postprocessing residual color due to the dye comes into question.

SUMMARY OF THE INVENTION

It is an object of the present invention to provide a silver halide photographic light-sensitive material which is so excellent in the antistatic characteristic as to generate few or no pinholes and which shows almost no residual color after its processing.

The above object of the invention is accomplished by a silver halide photographic light-sensitive material comprising a support having thereon at least one silver halide emulsion layer, in which said support has on the opposite side thereof to said emulsion layer an antistatic layer which contains (1) a water-soluble conductive polymer, (2) hydrophobic polymer particles and (3) an epoxy curing agent, and a hydrophilic colloid layer, adjacently provided on said antistatic layer, which contains a dye represented by the following Formula I:

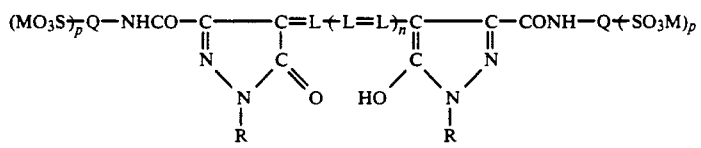

Formula I wherein Qs each independently represent an aliphatic group or an aromatic group; R is a hydrogen atom, an aliphatic group or an aromatic group; Ms each independently represent a cation; L is a methine group; n is an integer of 0, 1 or 2; and p is an integer of 1 or 2.

DETAILED DESCRIPTION OF THE INVENTION

The silver halide photographic light-sensitive material of the invention has a hydrophilic colloid layer containing a dye represented by the following Formula I:

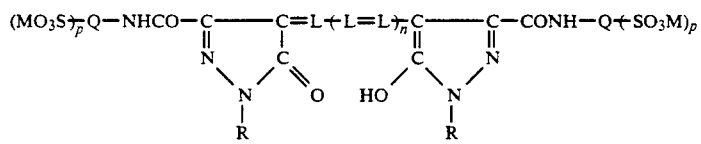

Formula I wherein Qs each independently represent an aliphatic group or an aromatic group; R is a hydrogen atom, an aliphatic group or an aromatic group; Ms each independently represent a cation; L is a methine group; n is an integer of 0, 1 or 2; and p is an integer of 1 or 2.

The aliphatic group represented by Q is an alkyl group having 1 to 4 carbon atoms, such as methyl, ethyl, n-propyl or n-butyl, while the aromatic group represented by Q is an aryl group such as phenyl or naphthyl. Each of these aliphatic and aromatic groups may further have a non-sulfo-group substituent including a halogen atom such as fluorine or chlorine, an alkyl group such as methyl or ethyl, a hydroxy group, and an alkoxy group such as methoxy.

The aliphatic group represented by R is an alkyl group having 1 to 4 carbon atoms, such as methyl, ethyl or propyl group, while the aromatic group represented by R is an aryl group such as phenyl or naphthyl. Each of these aliphatic and aromatic groups may further have a substituent including a halogen atoms such as fluorine, chlorine or bromine, an alkyl group such as methyl or ethyl, an aryl group such as phenyl, a carboxyl group, a sulfo group, a hydroxy group, an alkoxy group such as methoxy, and an aryloxy group such as phenoxy group.

The cation represented by M is a hydrogen atom, an alkali metal such as sodium or potassium, an alkaline earth metal such as calcium, ammonium or an organic base such as triethylamine, pyridine, piperidine or morpholine.

The methine group represented by L may be substituted with an alkyl group such as methyl or ethyl, an aryl group such as phenyl, or a halogen atom such as chlorine or bromine.

When p is an integer of 2, both $SO_3Ms$, wherein M is a cation, may be either the same or different.

The following are the typical examples of the dye represented by Formula I.

Exemplified compounds:

I-1

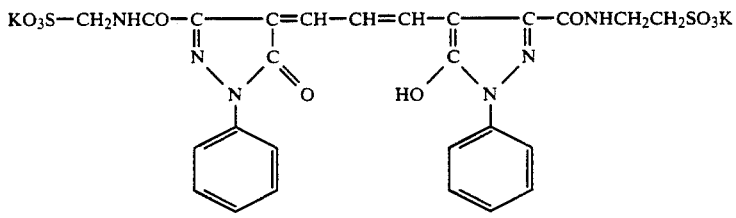

I-2

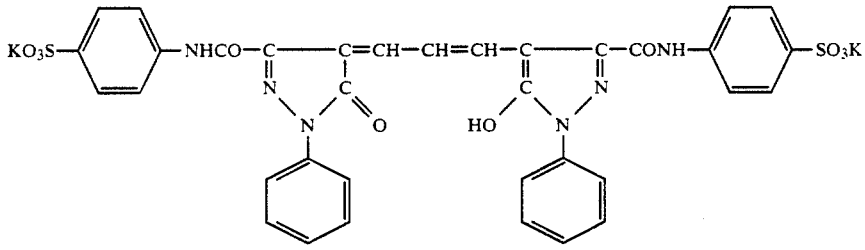

I-3

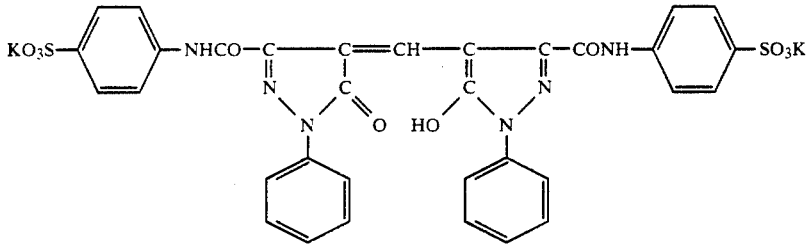

I-4

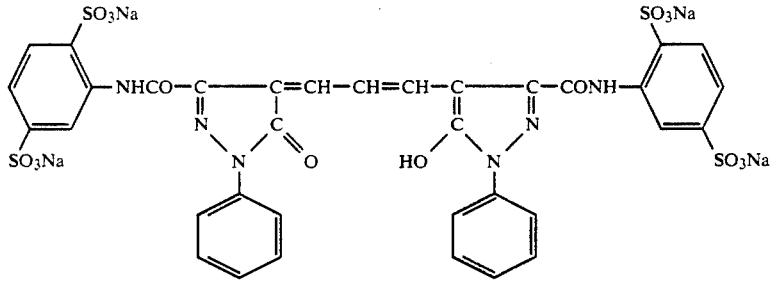

I-5

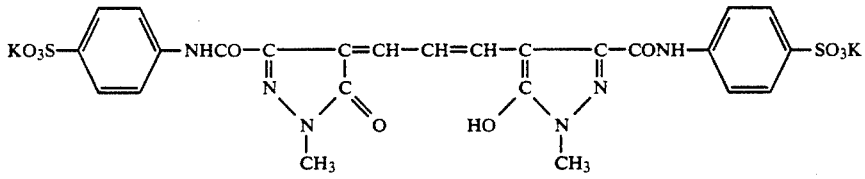

I-6

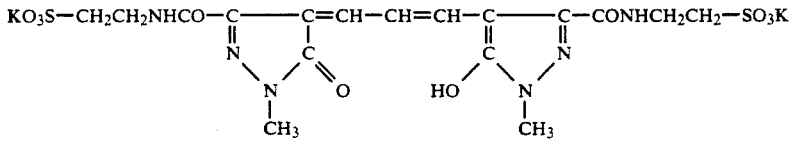

-continued
Exemplified compounds:
I-7
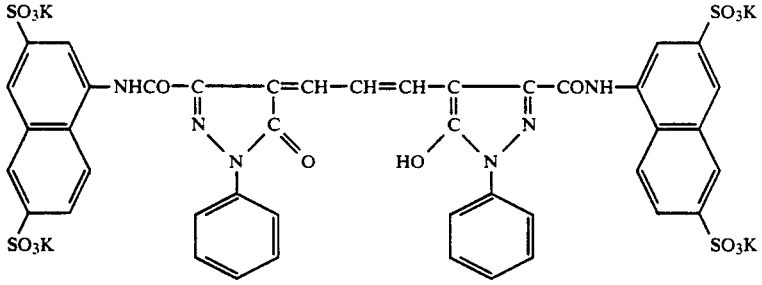
I-8
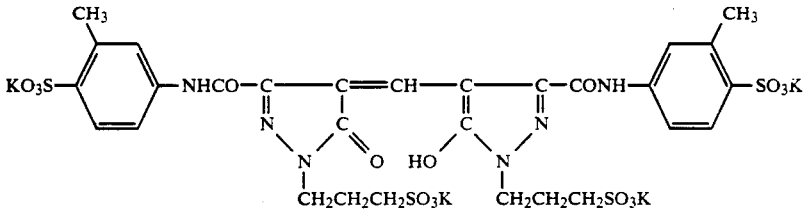
I-9
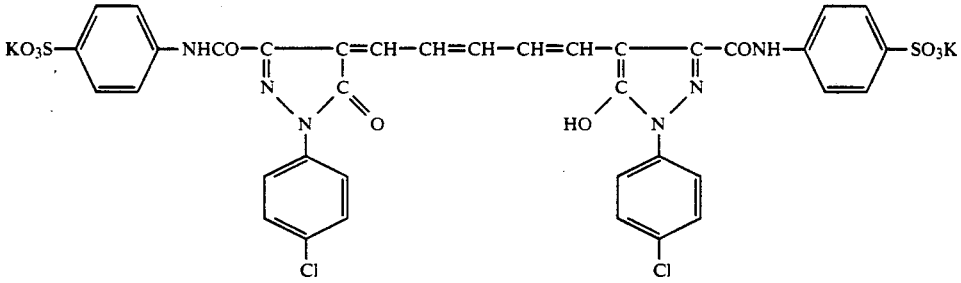
I-10
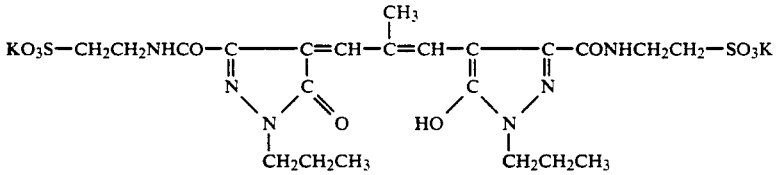
I-11
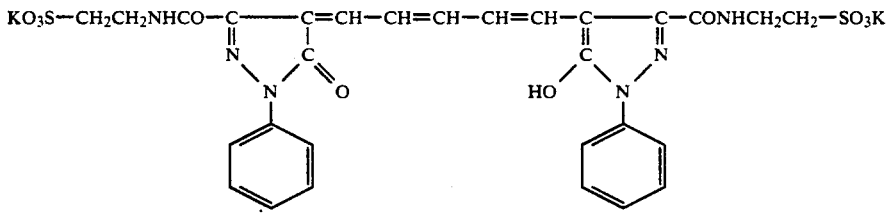
I-12
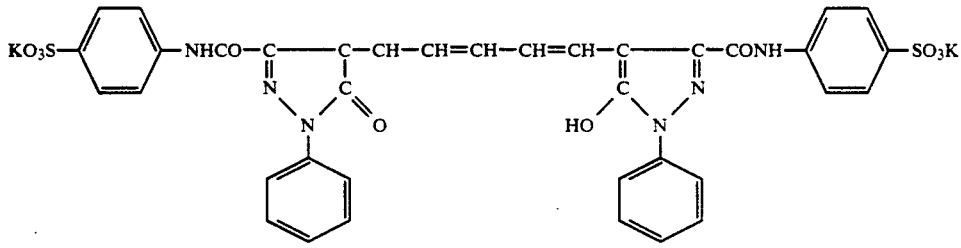

-continued
Exemplified compounds:
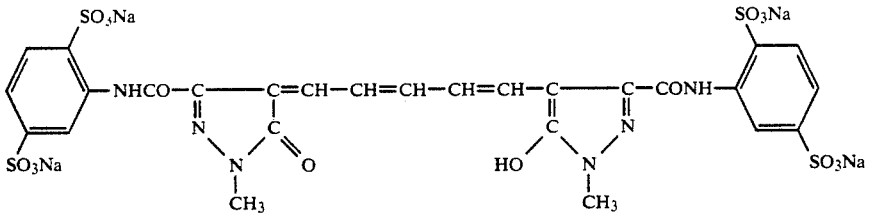
I-13
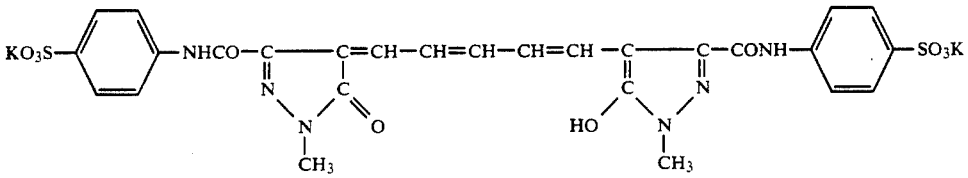
I-14
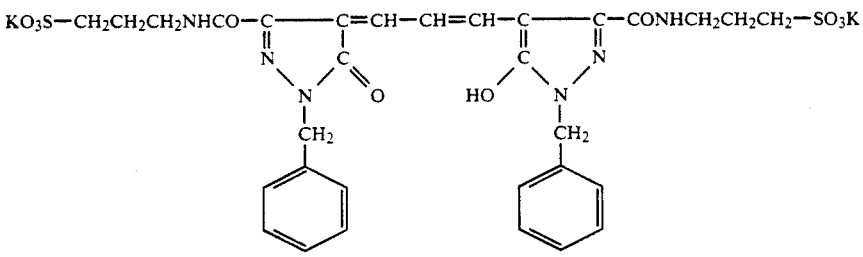
I-15
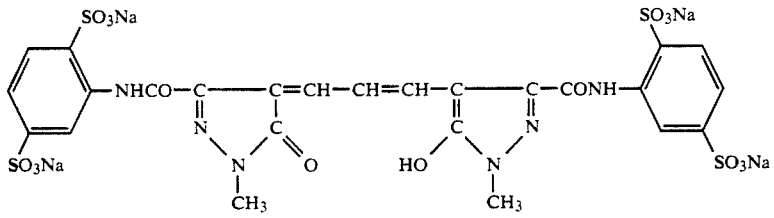
I-16
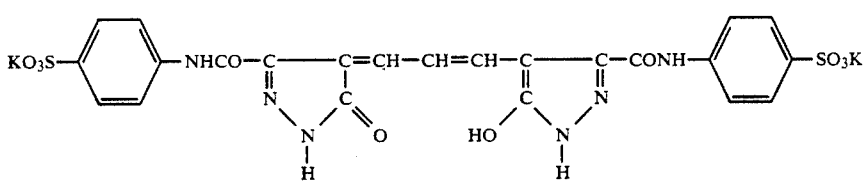
I-17
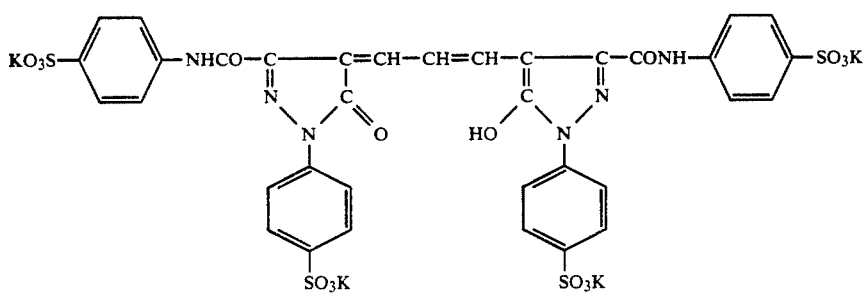
I-18

-continued
Exemplified compounds:
I-19
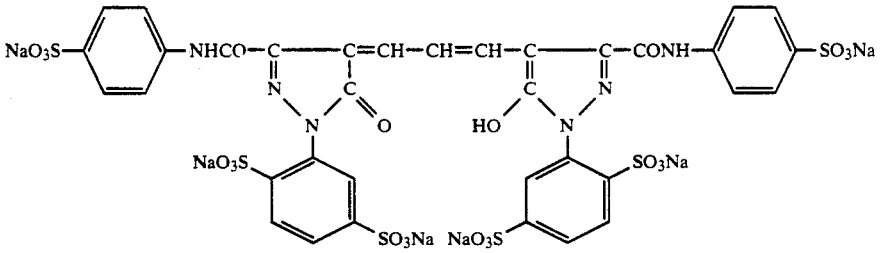
I-20
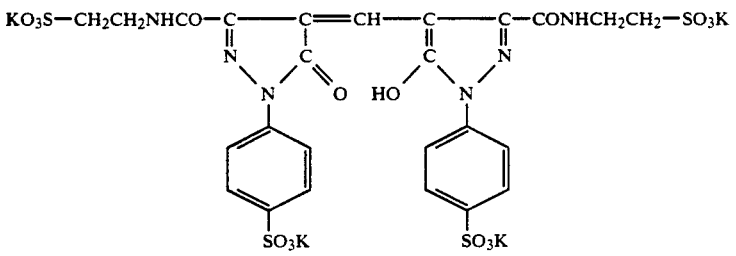
I-21
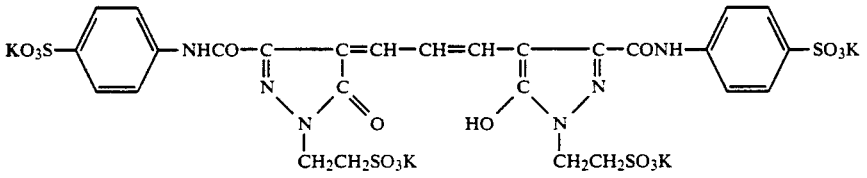
I-22
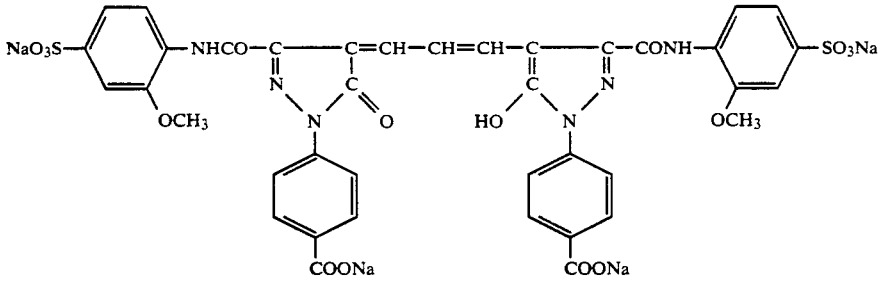
I-23
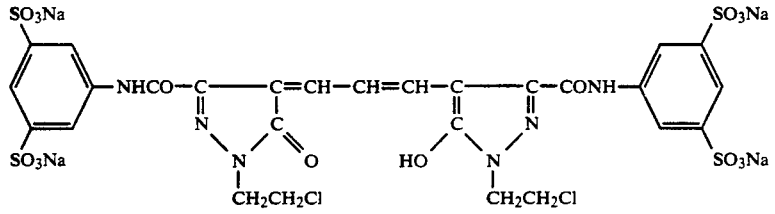
I-24
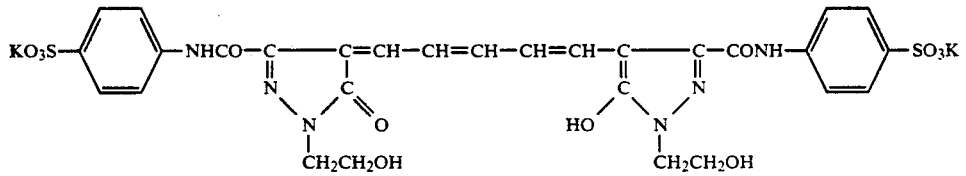

-continued

Exemplified compounds:

I-25

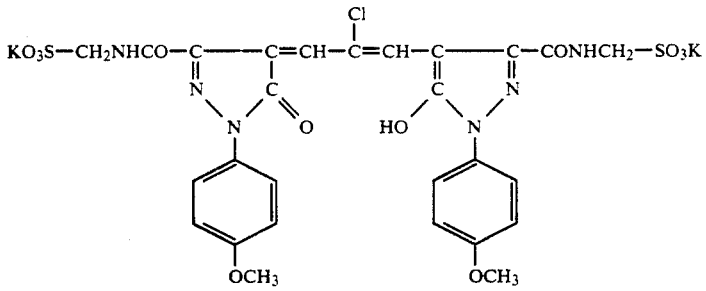

I-26

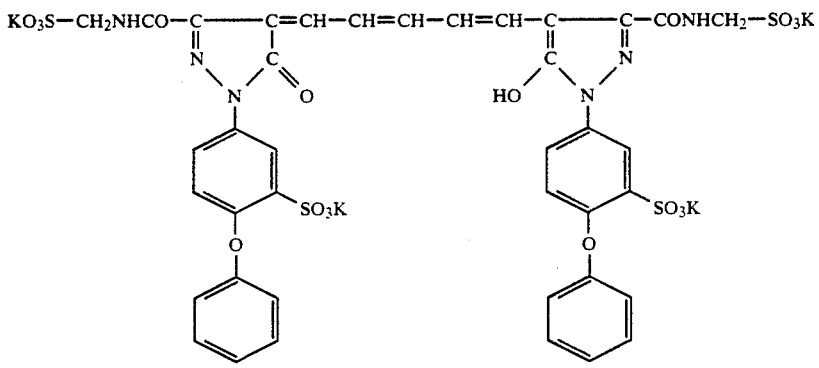

In the silver halide photographic light-sensitive material of the invention, the dye represented by Formula I may also be used as an antiirradiation dye for its emulsion layer or as a filter or antihalation dye for its non-light-sensitive hydrophilic colloid layer. Further, the dye may be used in combination of two or more kinds thereof or in combination with different other dyes according to purposes for which the dye is used. The incorporation of the dye of the invention into the hydrophilic colloid layer or silver halide emulsion layer can be easily carried out in the usual manner; in general, an aqueous solution of the dye or an organic or inorganic alkali salt of it is added to a coating liquid for the layer formation. The dye content of the light-sensitive material is usually 1.0 to 1000 mg per $m^2$ of the light-sensitive material.

The hydrophilic colloid used for the hydrophilic colloid layer of the invention is preferably gelatin.

The gelatin content of the layer on the invention's dye-containing side is preferably not more than 4.0 $g/m^2$, and more preferably 0.5 $g/m^2$ to 3.5 $g/m^2$.

In the invention, the hydrophilic colloid layer containing the dye represented by Formula I is provided adjacent to an antistatic layer containing a water-soluble conductive polymer, a hydrophobic polymer and an epoxy curing agent which is provided on the opposite side of the support to the emulsion coated side.

The water-soluble conductive polymer is a polymer comprising monomers having at least one conductive group selected from the class consisting of a sulfonic acid group, a sulfate group, a quaternary ammonium salt group, a tertiary ammonium salt group, a carboxyl group and a polyethylene-oxide group. In the invention, it may be either a homopolymer comprised of some of the above monomers alone or a copolymer of these with other monomers.

In the invention, the preferred among these conductive groups are the sulfonic acid group, sulfuric acid ester group and quaternary ammonium salt group. The polymer is required to contain monomer units having the conductive group in a ratio of 5 to 80% by weight.

The water-soluble conductive polymer used in the invention, in addition to the above conductive group-having monomer, may also contain other monomer having a hydroxyl group, an amino group, an epoxy group, an aziridine group, an active methylene group, a sulfinic acid group, an aldehyde group or a vinylsulfonic acid group. The molecular weight of the polymer is preferably 3,000 to 100,000 and more preferably 3,500 to 50,000.

The following are the examples of the water-soluble conductive polymer used in the invention.

P-1

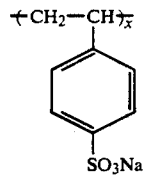

$\overline{M} \approx 60{,}000$

P-2

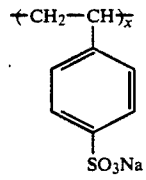

$\overline{M} \approx 70{,}000$

P-3

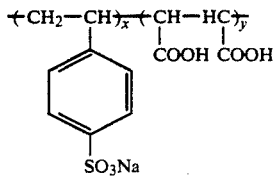

x:y = 67:34

$\overline{M} \approx 5{,}000$

-continued

P-4

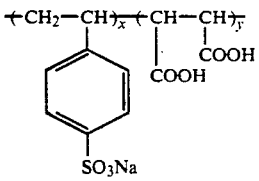

x:y = 50:50
$\overline{M} \approx 12,000$

P-5

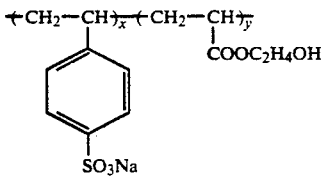

x:y = 70:30
$\overline{M} \approx 5,000$

P-6

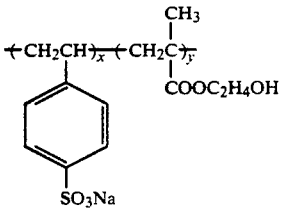

x:y = 90:10
$\overline{M} = 10,000$

P-7

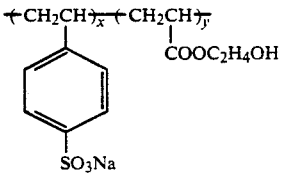

x:y = 60:40
$\overline{M} = 7,000$

P-8

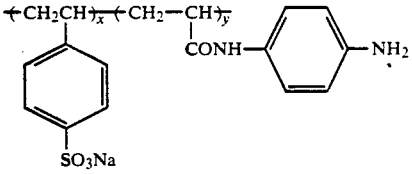

x:y = 90:10
$\overline{M} = 15,000$

P-9

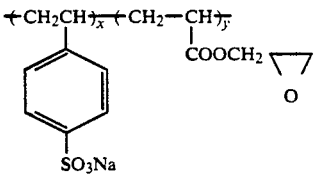

x:y = 60:40
$\overline{M} = 5,000$

P-10

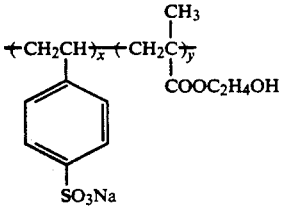

x:y = 90:10
$\overline{M} = 20,000$

P-11

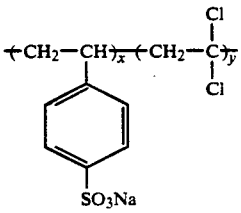

x:y = 97:3
$\overline{M} \approx 30,000$

-continued

P-12

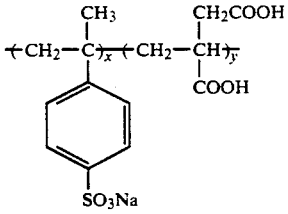

x:y = 98:2
$\overline{M} \approx 5,000$

P-13

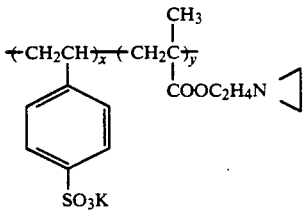

x:y = 60:40
$\overline{M} = 8,000$

P-14

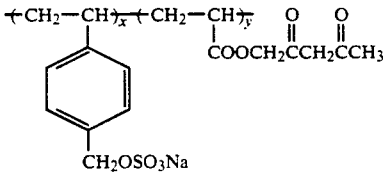

x:y = 95:5
$\overline{M} \approx 25,000$

P-15

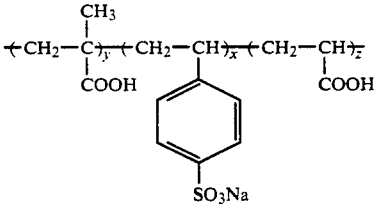

x:y:z = 80:19:1
$\overline{M} \approx 5,000$

P-16

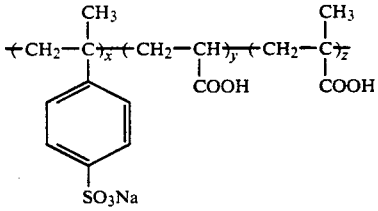

x:y:z = 70:28:2
$\overline{M} \approx 6,000$

P-17

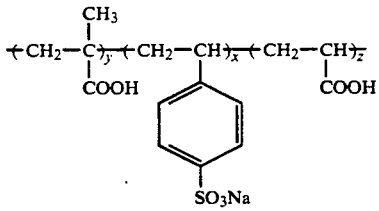

x:y:z = 85:13:2
$\overline{M} \approx 8,000$

P-18

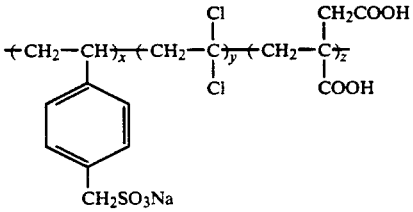

x:y:z = 80:16:4
$\overline{M} \approx 10,000$

-continued

P-19

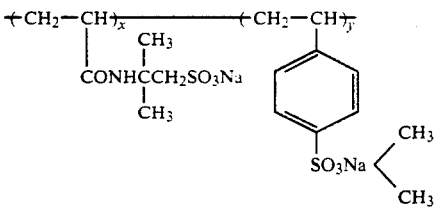

x:y = 90:10
$\overline{M} \approx 30,000$

P-20

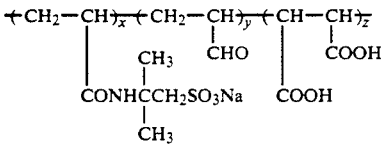

x:y:z = 85:10:5
$\overline{M} \approx 10,000$

P-21

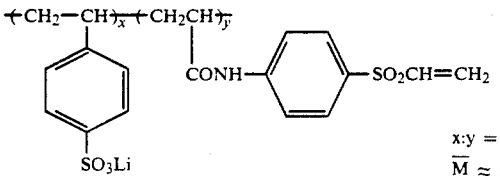

x:y = 90:10
$\overline{M} \approx 6,000$

P-22

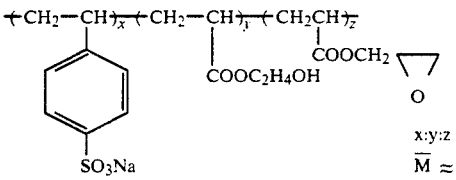

x:y:z = 80:10:10
$\overline{M} \approx 15,000$

Dextran sulfate Substitution degree: 2.0 M = 100,000 P-23

P-24

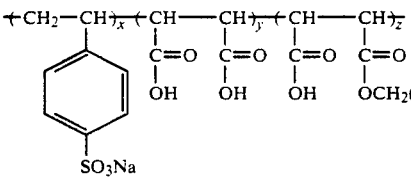

x:y:z = 50:40:10
$\overline{M} \approx 100,000$

P-25

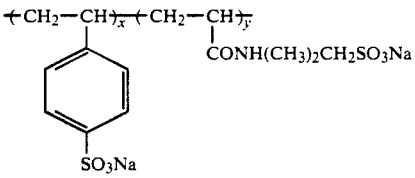

x:y = 80:20
$\overline{M} \approx 50,000$

P-26

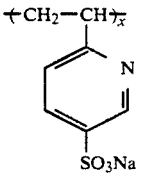

$\overline{M} \approx 100,000$

P-27

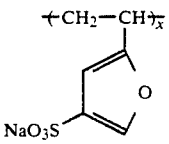

$\overline{M} \approx 20,000$

-continued

P-28

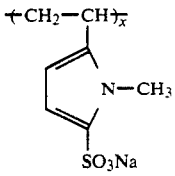

$\overline{M} \approx 20,000$

P-29

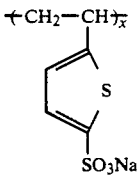

$\overline{M} \approx 150,000$

P-30

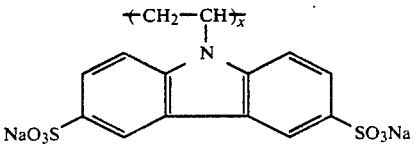

$\overline{M} \approx 300,000$

P-31

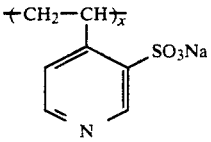

$\overline{M} \approx 280,000$

P-32

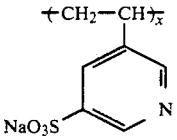

$\overline{M} \approx 50,000$

P-33

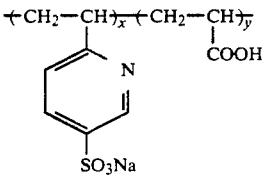

x:y = 60:40
$\overline{M} \approx 80,000$

P-34

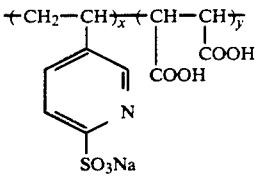

x:y = 70:30
$\overline{M} \approx 5,000$

P-35

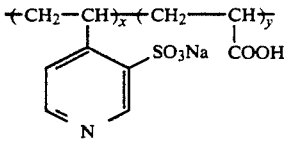

x:y = 80:20
$\overline{M} \approx 50,000$

P-36

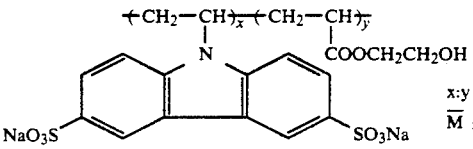

x:y = 75:25
$\overline{M} \approx 40,000$

-continued

P-37

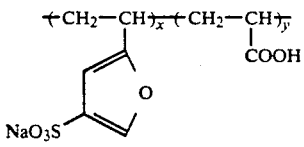

x:y = 80:20
$\overline{M}$ = 60,000

P-38

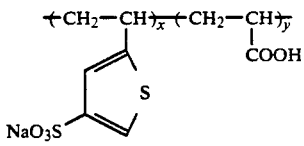

x:y = 90:10
$\overline{M} \approx$ 40,000

P-39

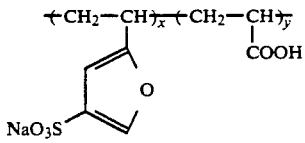

x:y = 55:45
$\overline{M} \approx$ 20,000

P-40

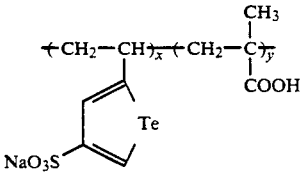

x:y = 90:10
$\overline{M}$ = 60,000

P-41

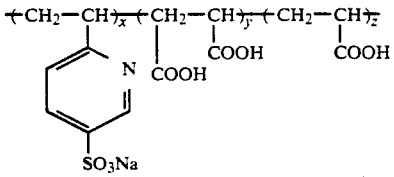

x:y:z = 80:10:10
$\overline{M} \approx$ 10,000

P-42

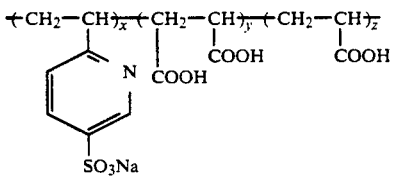

x:y:z = 70:25:5
$\overline{M} \approx$ 30,000

P-43

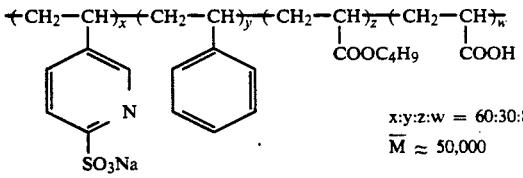

x:y:z:w = 60:30:8:2
$\overline{M} \approx$ 50,000

P-44

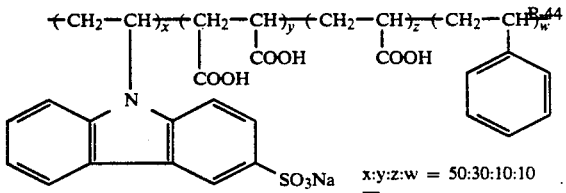

x:y:z:w = 50:30:10:10
$\overline{M} \approx$ 60,000

-continued

P-45

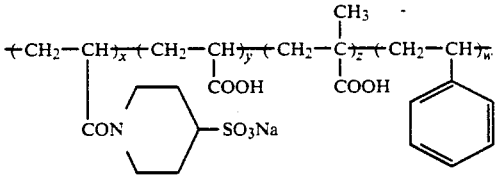

x:y:z:w = 40:30:20:10
$\overline{M} \approx$ 50,000

P-46

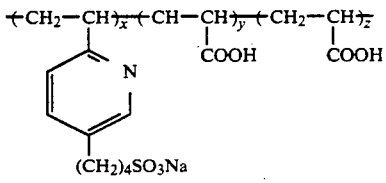

x:y:z = 60:30:10
$\overline{M} \approx$ 30,000

P-47

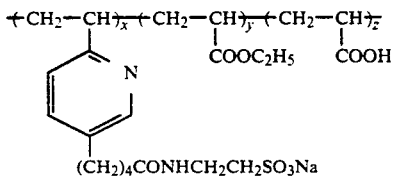

x:y:z = 80:5:15
$\overline{M} \approx$ 50,000

P-48

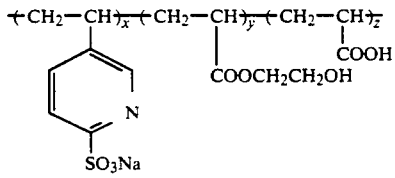

x:y:z = 55:35:10
$\overline{M} \approx$ 30,000

P-49

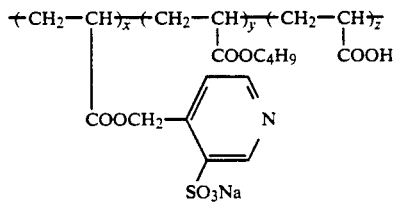

x:y:z = 50:10:40
$\overline{M} \approx$ 60,000

P-50

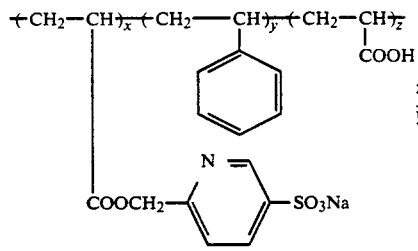

x:y:z = 60:10:30
$\overline{M} \approx$ 60,000

In the above exemplified compounds P-1 through P-50, x, y, z and w represent mole percentages of the respective monomers, and $\overline{M}$ represents the number average molecular weight of each compound.

These polymers can be produced by the polymerization of commercially available monomers or monomers prepared in the usual manner. The coating amount of these polymers is preferably 0.01 g to 10 g/m$^2$, and more preferably 0.1 g to 5 g/m$^2$. The polymer may be mixed with a single or various hydrophobic binders for the layer formation.

The hydrophobic polymer particles usable in the invention are those obtained by the polymerization of monomers in arbitrary combination selected from among styrene, styrene derivatives, alkyl acrylates, alkyl methacrylates, olefin derivatives, halogenated ethylene derivatives, acrylamide derivatives, methacylamide derivatives, vinyl ester derivatives and acrylonitrile; particularly those containing preferably at least 30 mol % and more preferably not less than 50 mol % of styrene derivative, alkyl acrylate or alkyl methacrylate.

The hydrophobic polymer particles in the invention are contained in a substantially-not-soluble-in-water state; the so-called latex state.

The hydrophobic polymer can be made into the latex state in two ways: one is a way of subjecting the polymer to emulsion polymerization and the other a way in which the polymer in a solid state is dissolved and finely dispersed in a low-boiling solvent and then the solvent is distilled out; the former is better in respect that more uniform and finer particles than the latter can be obtained.

A surfactant is used for the emulsion polymerization. The surfactant is preferably an anionic or nonionic surfactant, and the using amount thereof is preferably not more than 10% by weight of the monomer. The use of an excessive amount of the surfactant should be avoided in order not to fog the conductive layer.

The hydrophobic polymer preferably used in the invention has a molecular weight of 3000 or more. The polymer's transparency scarcely depends upon the molecular weight as long as it is at least 3000.

The antistatic layer of the invention contains the hydrophobic polymer particles in an amount of 0.01 $g/m^2$ to 5 $g/m^2$, preferably 0.1 $g/m^2$ to 2 $g/m^2$.

The following are the examples of the hydrophobic polymer.

Exemplified compounds

L-1

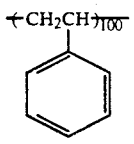

L-2

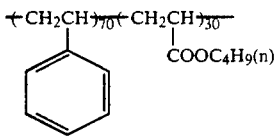

L-3

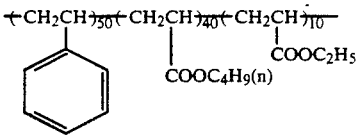

L-4

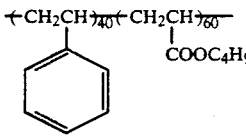

L-5

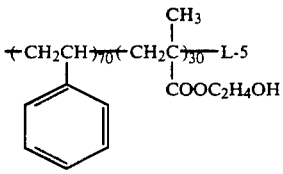

-continued

Exemplified compounds

L-6

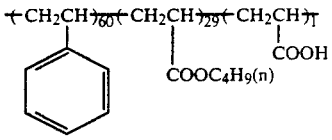

L-7

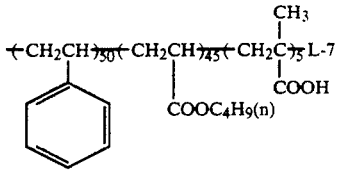

L-8

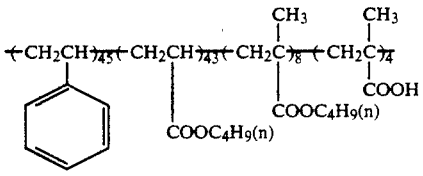

L-9

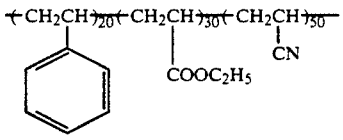

L-10

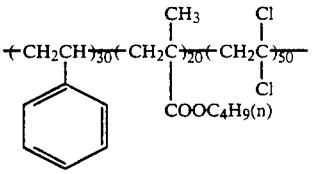

L-11

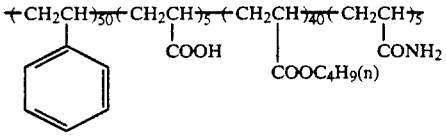

L-12

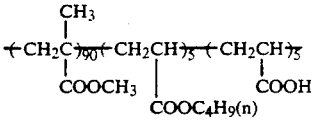

L-13

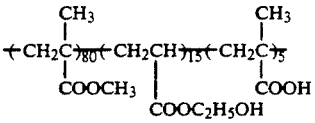

(L-14)

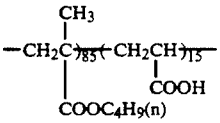

L-15

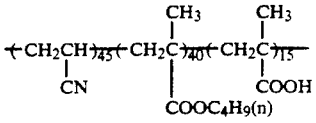

-continued
Exemplified compounds
L-16
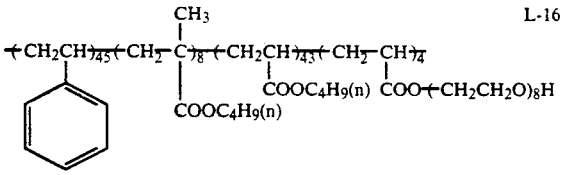
L-17
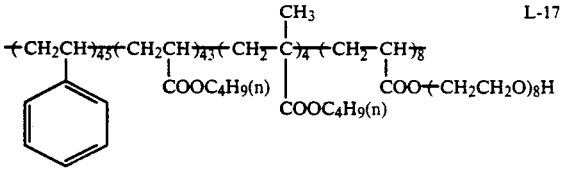
L-18
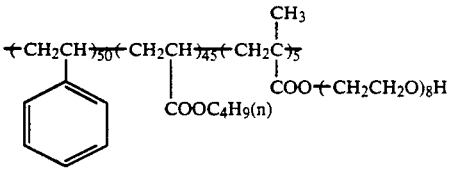
L-19
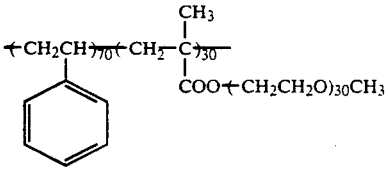
L-20
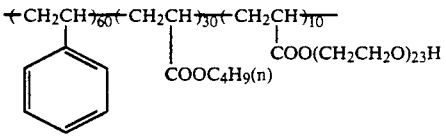
L-21
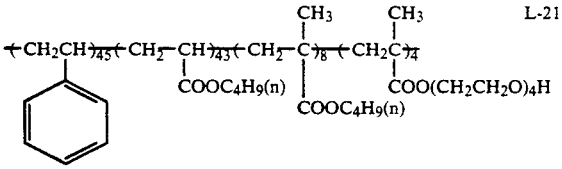
L-22
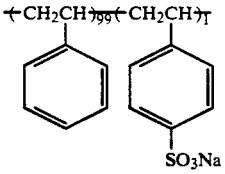
L-23
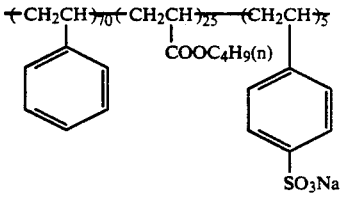
L-24
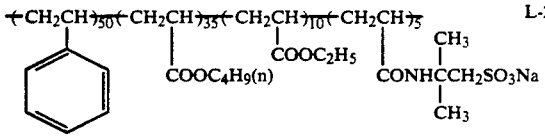
-continued
Exemplified compounds
L-25
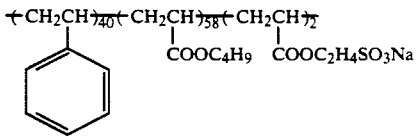
L-26
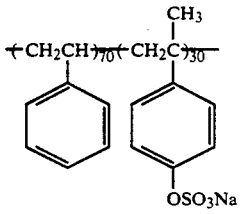
L-27
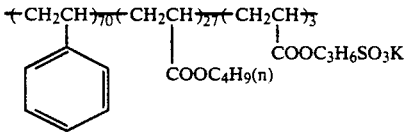
L-28
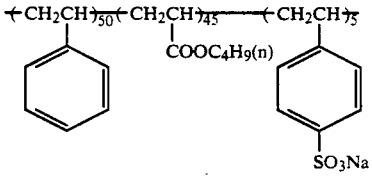
L-29
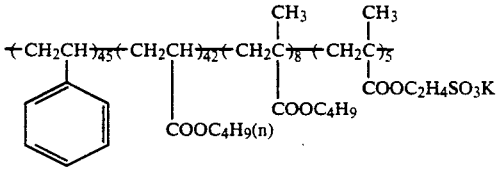
L-30
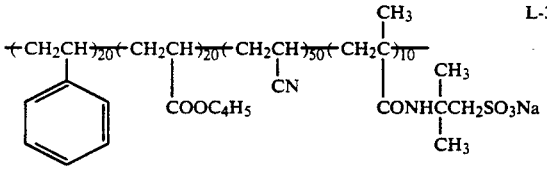
L-31
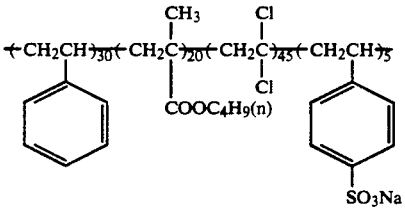
L-32
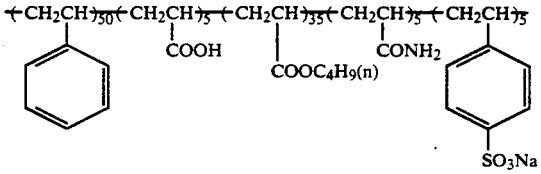

-continued

Exemplified compounds

L-33

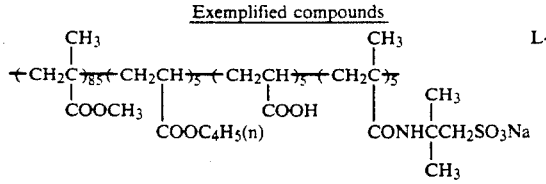

L-34

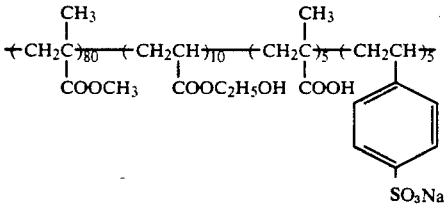

L-35

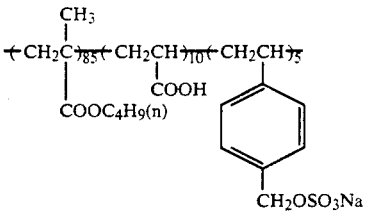

L-36

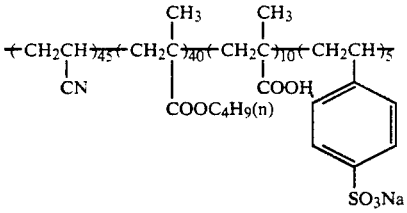

The epoxy curing agent used in the invention is preferably a hydroxy-containing epoxy curing agent; more particularly a polyglycidol-epihalohydrine reaction product. This product is considered to be a mixture from the reaction method point of view, but may be either an isolated one or a mixture as long as the number of hydroxy groups and the number of epoxy groups are held at suitable values because the effect and characteristics of the invention are determined according to the numbers of hydroxy groups and of epoxy groups.

Preferred examples of the isolated hydroxy-containing epoxy curing agent used in the invention are compounds represented by the following Formula E:

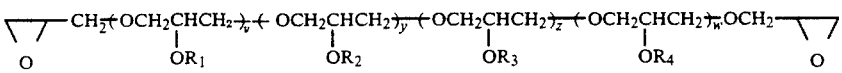

Formula E wherein x, y, z and w each represent an integer of 0 to 50; $R_1$ to $R_4$ each represent a hydrogen atom,

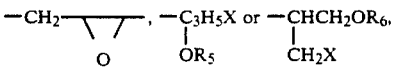

and may be either the same of different, wherein X is a halogen atom, and $R_5$ and $R_6$ each are a hydrogen atom or

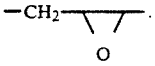

The following are the examples of the epoxy curing agent represented by Formula E.

E-1

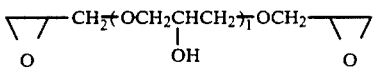

E-2

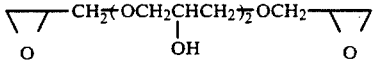

E-3

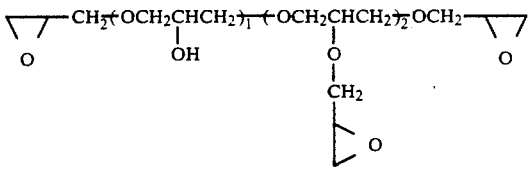

E-4

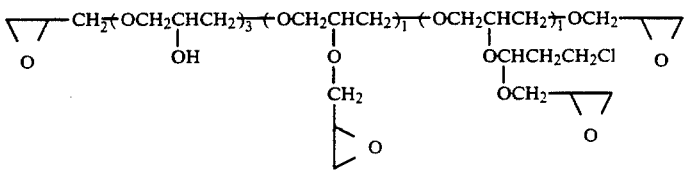

-continued

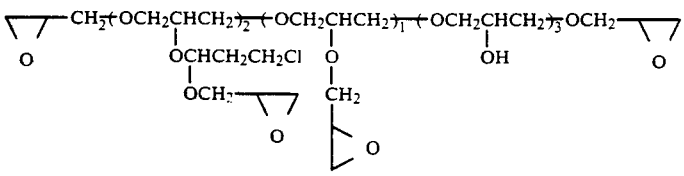

E-5

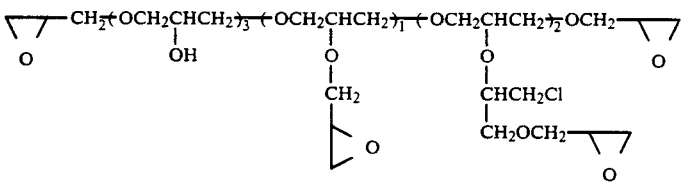

E-6

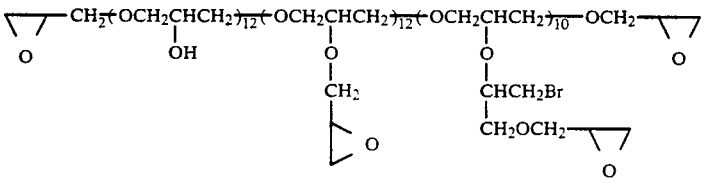

E-7

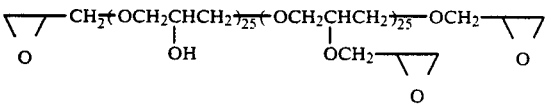

E-8

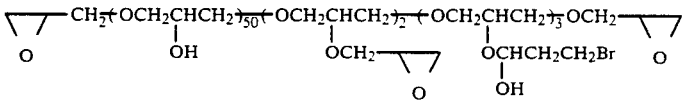

E-9

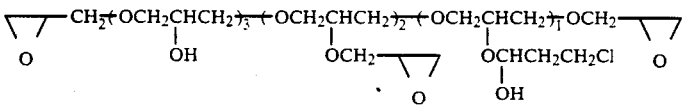

E-10

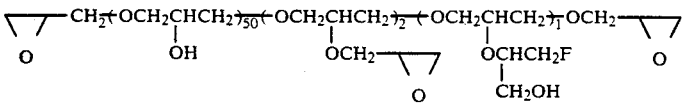

E-11

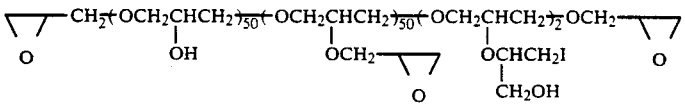

E-12

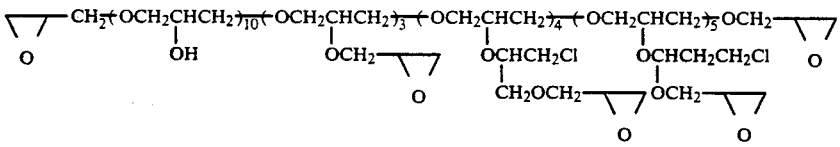

E-13

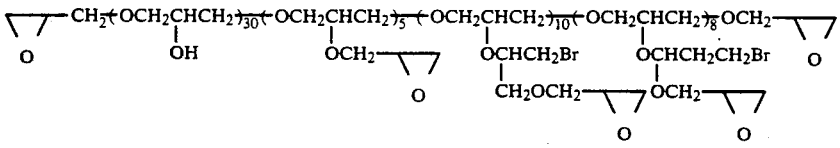

E-14

The epoxy curing agent in the invention may be added in the form of a solution of it dissolved in water or an organic solvent such as alcohol or acetone or in the form of a dispersion of it dispersed by use of a surfactant such as dodecylbenzene sulfonate or nonylphenoxyalkylene oxide. The adding amount of the agent is preferably 1 to 1000 mg/m$^2$.

The silver halide emulsion of the light-sensitive material of the invention may comprise any arbitrary one of silver halides such as silver bromide, silver chloride, silver iodobromide, silver chlorobromide and silver chloroiodobromide. The silver halide may be prepared by any one of the acidic process, neutral process and ammoniacal process.

The silver halide grain may be either a grain having thereinside a uniform silver halide composition distribution or a core/shell grain with its core phase different in the silver halide composition from its shell phase; and may also be either of the type of forming a latent image mainly on its surface or of the type of forming a latent image mainly thereinside.

The silver halide grain used in the invention may have an arbitrary crystal form. A preferred example of the form is a cube having {100} crystal planes. There may also be used octahedral, tetradecahedral or dodecahedral silver halide grains prepared in accordance with appropriate one of the methods described in U.S. Pat. Nos. 4,183,756 and 4,225,666, JP O.P.I. No. 26589/1980, JP E.P. No. 42737/1980, and J. Photogr. Sci. 21, 39 (1973). Further, twin planes-having silver halide grains may also be used.

The silver halide grains used in the invention may be either grains of a single form or a mixture of grains of various forms.

The silver halide emulsion of the invention may have any grain size distribution; i.e., may be a polydisperse emulsion having a wider grain size distribution, a monodisperse emulsion having a narrower grain size distribution or a mixture of the polydisperse and monodisperse emulsions. In the invention, a monodisperse emulsion is preferably used.

The silver halide emulsion may be a mixture of two or more different silver halide emulsions separately prepared.

The silver halide emulsion may be used in the form of a primitive emulsion, not chemically sensitized, but is usually chemically sensitized. For the chemical sensitization reference can be made to the publications by Glafkides and Zelikman, and the Die Grundlag en der Photographischen Prozesse mit Silberhalogeniden, edited by H. Frieser, Akademishe Verlagsgesellschaft, 1968.

The chemical sensitization can be carried out by a sulfur sensitization process with an active gelatin or a compound containing sulfur capable of reacting with silver ions, a reduction sensitization process with a reductive material, or a noble metal sensitization process with a gold compound or other noble metal compound. These processes of sensitizations can be applied in combination.

The chemical sensitization is performed at a pH of preferably 4 to 9, more preferably 5 to 8; at a pAg of preferably 5 to 11, more preferably 7 to 9; and at a temperature of preferably 40° to 90° C. and more preferably 45° to 75° C.

As the light-sensitive emulsion, the foregoing emulsions may be used alone or in a mixture thereof.

After completion of the above chemical sensitization, to the emulsion may be added stabilizers such as 4-hydroxy-6-methyl-1,3,3a,7-tetrazaindene, 5-mercapto-1-phenyltetrazole, 2-mercaptobenzothiazole. A silver halide solvent such as thioether, and crystal habit control agents such as mercapto-containing compounds and sensitizing dyes, can be used, if necessary, in the course of the emulsion preparation.

The silver halide grains used in the invention may contain thereinside and/or on the surface thereof metallic ions by adding a cadmium salt, a zinc salt, a lead salt, a thalium salt, an iridium salt or complex salt, a rhodium salt or complex salt, or an iron salt or complex salt in the course of the grain forming and/or growing process.

The emulsion used in the invention may have its useless water-soluble salt removed after completion of the growth of its silver halide grains. The salt may be removed in accordance with the method described in Research Disclosure 17643.

Further, according to purposes, to the light-sensitive material of the invention may be added various additives, which are detailed in Research Disclosure vol. 176, Item 17643 (Dec. 1978) and vol. 187, Item 18716 (Nov. 1979).

Useful materials as the elastic support of the light-sensitive material of the invention include films of semisynthetic or synthetic polymers such as cellulose nitrate, cellulose acetate, cellulose butyrate, polystyrene, polyvinyl chloride, polyethylene terephthalate and polycarbonate. The support may be tinted with a dye or pigment. Generally, a subbing layer is coated on the surface of the support in order to improve its adhesiveness with an emulsion layer. The subbing layer coating is preferably made as described in JP O.P.I. Nos. 104913/1977, 18949/1984, 19940/1984 and 11941/1984.

In the silver halide light-sensitive material of the invention, the photographic emulsion layer and other hydrophilic colloid layer are coated on the support or on other layer in accordance with appropriate one of various coating processes, such as a dip coating process, a roller coating process, a curtain coating process and an extrusion coating process.

The light-sensitive material of the invention may be processed in accordance with various processing methods well-known to those skilled in the art.

EXAMPLES

EXAMPLE 1

An aqueous silver nitrate solution and an aqueous potassium bromide-sodium chloride mixture solution to which were added $2\times10^{-6}$ mol/mol Ag of potassium hexachloroiridate and $4\times10^{-7}$ mol/mol Ag of silver halide of potassium hexabromorhodate were added by a double-jet process to a mixture of gelatin, sodium chloride and water put in a vessel heated at 40° C. with keeping pH at 3.0 and pAg at 7.7, whereby cubic silver chlorobromide emulsion containing 35 mol % silver bromide, having a grain size distribution coefficient of 12% and an average grain size of 0.33 μm, were prepared. The grain size distribution coefficient is calculated from the following equation:

$$\text{Size distribution coefficient (\%)} = \frac{\text{Standard deviation of grain size}}{\text{Average grain size}} \times 100$$

The emulsion, after returning pH to 5.9, was desalted in the usual manner.

This emulsion was subjected to gold-sulfur sensitization, and then to spectral sensitization with use of 40 mg/mol Ag of the following sensitizing dye (a), and further to the emulsion were added 70 mg/mol Ag of 1-phenyl-5-mercaptotetrazole, 1.2 g/mol Ag of 4-hydroxy-6-methyl-1,3,3a,7-tetrazaindene, 0.7 g/mol Ag of potassium bromide and gelatin, and then the ripening of the emulsion was stopped.

Sensitizing dye (a)

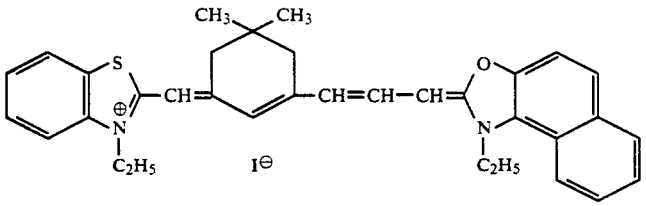

Emulsion layer

An emulsion coating liquid prepared by adding to the above emulsion the following additives so as to have the following coating weights was coated on a 100 μm-thick polyethylene terephthalate support subjected to latex subbing treatment and corona discharge treatment.

| | |
|---|---|
| Latex of styrene-butyl acrylate-acrylic acid coplymer | 1.0 g/m² |
| Tetraphenylsulfonium chloride | 30 mg/m² |
| Potassium bromide | 30 mg/m² |
| Saponin | 200 mg/m² |
| Polyethylene glycol | 100 mg/m² |
| Sodium dodecylbenzenesulfonate | 100 mg/m² |
| Hydroquinone | 200 mg/m² |
| Phenydone | 10 mg/m² |
| Sodium styrenesulfonate-maleic acid copolymer (Mw = 250,000) | 200 mg/m² |
| Gallic acid butyl ester | 500 mg/m² |
| 5-Methylbenzotriazole | 30 mg/m² |
| 2-Mercaptobenzimidazole-5-sulfonic acid | 30 mg/m² |
| Inert osein gelatin (isoelectric point: 4.9) | 1.5 g/m² |
| 1-(p-acetylamidophenyl)-5-mercaptotetrazole | 30 mg/m² |
| Silver | 4.0 g/m² |

Protective layer

A protective layer coating liquid containing the following components prepared so as to have the following coating weights was coated on the above emulsion layer.

| | |
|---|---|
| Fluorinated dioctyl sulfosuccinate | 300 mg/m² |
| Matting agent: polymethyl methacrylate (average particle size: 5.5 μm) | 50 mg/m² |
| Silica (average particle size: 3.5 μm) | 200 mg/m² |
| Lithium nitrate | 30 mg/m² |
| Potassium bromide | 25 mg/m² |
| Acid-treated gelatin (isoelectric point: 7.0) | 0.8 g/m² |
| Colloidal silica | 50 mg/m² |
| Sodium styrenesulfonate-maleic acid copolymer | 100 mg/m² |
| Sodium 1-hydroxy-3,5-dichloro-s-triazine | 35 mg/m² |

Antistatic layer

The opposite side surface of the support to the above emulsion side was in advance subjected to corona discharge treatment at a power of 30 w/m² per minute. Next, on the corona discharge-treated surface of the support was coated poly(styrene-butyl acrylate-glycidyl methacrylate) latex polymer in the presence of a hexamethyleneaziridine hardening agent; again corona discharge-treated; and then further coated an antistatic layer coating liquid containing the water-soluble conductive polymer P, hydrophobic polymer particles L and a curing agent shown in Table 1 so as to have the coating weights as given in Table 1 at a coating rate of 33 m/min by using a rollfit coating pan and an air knife.

The coated layer was dried at 90° C. for 2 minutes, and then subjected to heat treatment at 140° C. for 90 minutes. Next, on this antistatic layer were coated a backing layer and a protective layer of the following compositions so as to have the following coating weights:

| Backing layer | |
|---|---|
| Hydroquinone | 100 mg/m² |
| Phenydone | 30 mg/m² |
| Latex of butyl acrylate-styrene copolymer | 0.5 g/m² |
| Styrene-maleic acid copolymer | 100 mg/m² |
| Citric acid | 40 mg/m² |
| Benzotriazole | 100 mg/m² |

The following backing dyes (a), (b) and a dye given in Table 1

| | |
|---|---|
| Osein gelatin | 2.0 g/m² |
| Dye (a) | 40 mg/m² |

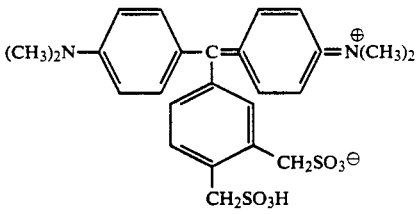

| | |
|---|---|
| Dye (b) | 80 mg/m² |

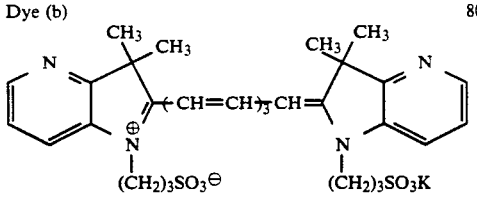

| Protective layer | |
|---|---|
| Gelatin | 1.0 g/m² |
| Matting agent: polymethyl methacrylate | 36 mg/m² |
| Bis-(2-ethylhexyl) sulfosuccinate | 10 mg/m² |
| Sodium chloride | 80 mg/m² |
| Glyoxal | 17 mg/m² |
| Sodium styrenesulfonate-maleic acid copolymer | 200 mg/m² |
| Lithium nitrate | 30 mg/m² |

Each of Samples No. 1 to No. 14 thus obtained was exposed and processed in the following developer and fixer solutions, and then evaluated.

| Developer | |
|---|---|
| Hydroquinone | 25 g |
| 1-Phenyl-4,4-dimethyl-3-pyrazolidone | 0.4 g |

-continued

| | |
|---|---|
| Sodium bromide | 3 g |
| 5-methylbenzotriazole | 0.3 g |
| 5-nitroindazole | 0.05 g |
| Diethylaminopropane-1,2-diol | 10 g |
| Potassium sulfite | 90 g |
| Sodium 5-sulfosalicylate | 75 g |
| Sodium ethylenediaminetetraacetate | 2 g |
| Water to make 1 liter. | |
| Adjust pH to 10.6 with sodium hydroxide. | |
| Fixer | |
| Composition A: | |
| Ammonium thiosulfate, 72.5w % aqueous solution | 240 ml |
| Sodium sulfite | 17 g |
| Sodium acetate, trihydrate | 6.5 g |
| Boric acid | 6 g |
| Sodium citrate, dihydrate | 2 g |
| Acetic acid, 90w % aqueous solution | 13.6 ml |
| Composition B: | |
| Pure water, ion-exchanged | 17 ml |
| Sulfuric acid, 50% aqueous solution | 3.0 g |
| Aluminum sulfate, $Al_2O_3$-equivalent 8.1w % aqueous solution | 20 g |

For use, the above Composition A and Composition B were dissolved in the described order in 500 ml of water, and water was added to make the whole quantity 1 liter. pH was about

| Processing steps | | |
|---|---|---|
| Developing | 34° C. | 15 seconds |
| Fixing | 33° C. | 10 seconds |
| Washing | Room temp. | 10 seconds |
| Drying | 50° C. | 10 seconds |

Evaluations for the following items were conducted as follows. The results are shown in Table 1.

Residual color

Each sample, unexposed, was processed and then the density of its residual color was determined by a densitometer PDA-65 of KONICA Corporation.

Pinholes

Each sample was uniformly exposed to light by a printer and processed. Pinholes formed on the processed sample were visually counted and rated according to the number of pinholes in the area of 20 cm×20 cm.

| Rank | Number of pinholes |
|---|---|
| 5 | 3 or less |
| 4 | 4 to 10 |
| 3 | 11 to 20 |
| 2 | 21 to 30 |
| 1 | 31 or more |

TABLE 1

| | Antistatic layer | | | | | | Backing | | | |
|---|---|---|---|---|---|---|---|---|---|---|
| | P | | L | | E | | layer dye | | Residual | |
| Sample No. | No. | g/m² | No. | g/m² | No. | g/m² | No. | g/m² | color | Pinholes |
| 1 (Comp.) | — | — | — | — | — | — | I-6 | 100 | 0.04 | 1 |
| 2 (Comp.) | P-3 | 0.6 | L-8 | 0.4 | e | 0.1 | I-6 | 100 | 0.07 | 4 |
| 3 (Inv.) | P-3 | 0.6 | L-8 | 0.4 | E-1 | 0.1 | I-6 | 100 | 0.04 | 4 |
| 4 (Comp.) | P-3 | 0.6 | L-8 | 0.4 | E-1 | 0.1 | s | 100 | 0.07 | 3 |
| 5 (Inv.) | P-3 | 0.6 | L-8 | 0.4 | E-1 | 0.1 | I-13 | 100 | 0.03 | 5 |
| 6 (Inv.) | P-3 | 0.2 | L-8 | 0.1 | E-1 | 0.1 | I-13 | 100 | 0.03 | 4 |
| 7 (Inv.) | P-7 | 0.6 | L-8 | 0.4 | E-1 | 0.1 | I-13 | 100 | 0.03 | 5 |
| 8 (Inv.) | P-7 | 0.6 | L-8 | 0.4 | E-7 | 0.2 | I-13 | 100 | 0.03 | 5 |
| 9 (Inv.) | P-7 | 0.6 | L-8 | 0.4 | E-7 | 0.2 | I-10 | 100 | 0.03 | 4 |
| 10 (Inv.) | P-7 | 0.6 | L-8 | 0.4 | E-7 | 0.2 | I-15 | 100 | 0.04 | 5 |
| 11 (Inv.) | P-7 | 0.6 | L-13 | 0.3 | E-7 | 0.2 | I-20 | 100 | 0.04 | 4 |
| 12 (Inv.) | P-7 | 0.6 | L-19 | 0.4 | E-8 | 0.2 | I-20 | 100 | 0.03 | 5 |
| 13 (Inv.) | P-13 | 0.7 | L-8 | 0.4 | E-8 | 0.2 | I-24 | 100 | 0.04 | 5 |

TABLE 1-continued

| | Antistatic layer | | | | | | Backing | | | |
|---|---|---|---|---|---|---|---|---|---|---|
| | P | | L | | E | | layer dye | | Residual | |
| Sample No. | No. | g/m² | No. | g/m² | No. | g/m² | No. | g/m² | color | Pinholes |
| 14 (Inv.) | P-13 | 0.7 | L-13 | 0.3 | E-8 | 0.2 | I-3 | 100 | 0.04 | 5 |

Comparative curing agent (e)

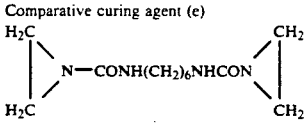

s

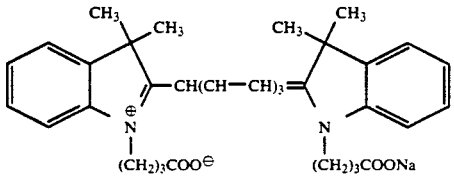

Comparative dyes

A

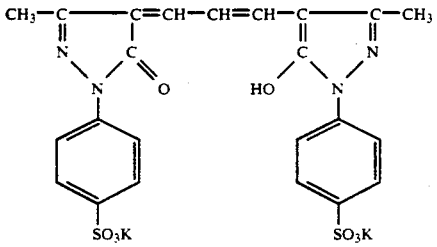

B

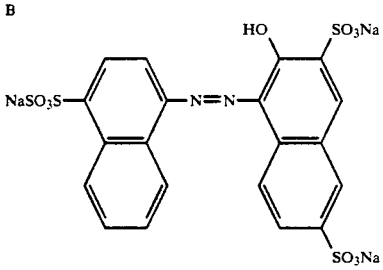

From the results shown in Table 1 it is apparent that the samples of the invention show less residual color and fewer pinholes than the comparative samples.

What is claimed is:

1. A silver halide photographic light-sensitive material comprising a support, a silver halide emulsion layer provided on a surface of said support, an antistatic layer comprising a water-soluble conductive polymer, hydrophobic polymer particles and an epoxy curing agent, which is porvided on the surface of said support opposite to the surface on which said emulsion layer is provided, and a hydrophilic colloid layer adjacently provided on said antistatic layer, which contains a dye represented by the following Formula I:

(I)

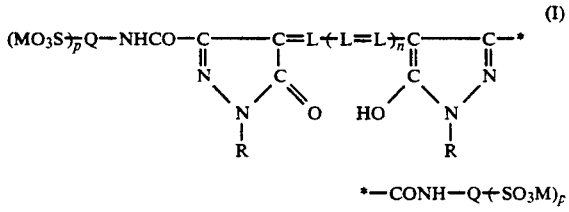

wherein Qs are independently an aliphatic group or an aromatic group; R is a hydrogen atom, an aliphatic group or an aromatic group; Ms are independently a cation; L is a methine group; n is an integer of 0, 1 or 2; and p is an integer of 1 or 2.

2. A material of claim 1, wherein said conductive polymer contains a repeating unit having a sulfonic acid group, a sulfuric acid ester group, a quarternary ammonium group. a tertiary ammonium group, a carboxyl group or a polyethylene oxide group in an amount of 5% to 80% by weight.

3. A material of claim 1, wherein said conductive polymer has a molecular weight of from 3000 to 100000.

4. A material of claim 1, wherein said antisatic layer contains said conductive polymer in an amount of from 0.1 g/m² to 5 g/m².

5. A material of claim 1, wherein said hydrophobic polymer comprises a styrene derivative, an alkyl acrylate or an alkyl metacrylate in an amount of not less than 30 mol %.

6. A material of claim 1, wherein said antistatic layer contains said hydrophobic polymer particles in an amount of from 0.1 g/m² to 2 g/m².

7. A material of claim 1, wherein said epoxy curing agent is a compound represented by the following Formula E:

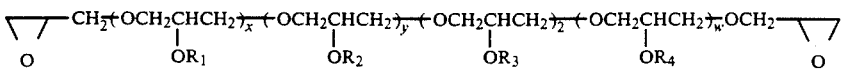

(E)

wherein w, x, y and z are independently an integer of 0 to 50; $R_1$, $R_2$, $R_3$ and $R_4$ are independently a hydrogen atom,

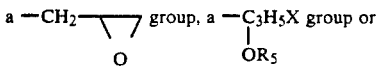

a group, a $-C_3H_5X$ group or

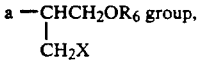

a group, in which X is a halogen atom; and $R_5$ and $R_6$ are independently a hydrogen atom or a

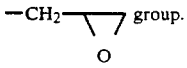

group.

8. A material of claim 1, wherein said antistatic layer contains said curing agent in an amount of from 1 $mg/m^2$ to 1000 $mg/m^2$.

9. A silver halide photographic light-sensitive material comprising a support, a silver halide emulsion layer provided on a surface of said support, an antistatic layer comprising a water-soluble conductive polymer represented by the foolowing Formula P-7, particles of hydrophobic polymer represented by the following Formula L-8 and an epoxy curing agent represented by the following Formula E-1, which is porvided on the surface of said support opposite to the surface on which said emulsion layer is provided, and a hydrophilic colloid layer adjacently provided on said antistatic layer, which contains a dye represented by the following Formula I-13:

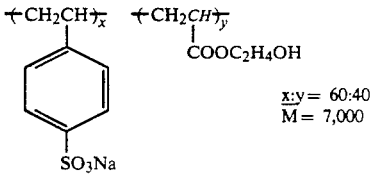

x:y = 60:40
M = 7,000

(P-7)

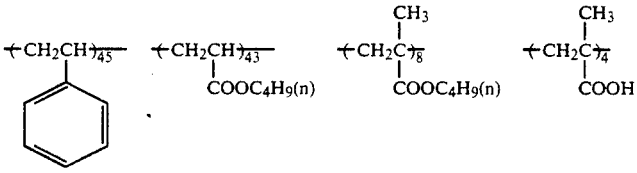

(L-8)

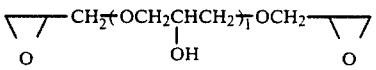

(E-1)

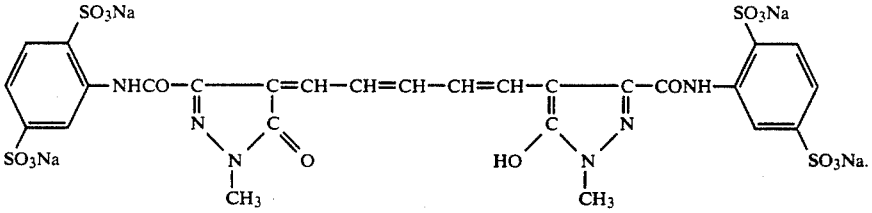

(I-13)

* * * * *